US006599088B2

(12) United States Patent
Stagg

(10) Patent No.: US 6,599,088 B2
(45) Date of Patent: Jul. 29, 2003

(54) DYNAMICALLY SEALING RING FAN SHROUD ASSEMBLY

(75) Inventor: Jonathan B. Stagg, Greencastle, IN (US)

(73) Assignee: BorgWarner, Inc., Auburn Hills, MI (US)

( * ) Notice: Subject to any disclaimer, the term of this patent is extended or adjusted under 35 U.S.C. 154(b) by 0 days.

(21) Appl. No.: 09/965,154

(22) Filed: Sep. 27, 2001

(65) Prior Publication Data

US 2003/0059297 A1 Mar. 27, 2003

(51) Int. Cl.[7] ..... F04D 29/08
(52) U.S. Cl. ..... 415/173.6; 416/192
(58) Field of Search ..... 413/173.6, 173.1, 413/172.1, 170.1; 415/189, 192, 195

(56) References Cited

U.S. PATENT DOCUMENTS 5,443,363 A * 8/1995 Cho ..... 415/211.1

* cited by examiner

*Primary Examiner*—Edward K. Look
*Assistant Examiner*—Kimya N. McCoy
(74) *Attorney, Agent, or Firm*—Artz & Artz, P.C.; Greg Dziegielewski, Esq.

(57) ABSTRACT

A fan assembly 10 is provided including at least one impeller blade 12, a rotating ring element 14 having a flared inner discharge surface 22, and a shroud element 20 having a shroud exit surface 32 substantially coincident with the flared inner discharge surface 22.

16 Claims, 2 Drawing Sheets

DYNAMICALLY SEALING RING FAN SHROUD ASSEMBLY

TECHNICAL FIELD

The present invention relates generally to a ring fan shroud assembly and more particularly, to a ring fan shroud assembly with dynamic sealing properties.

BACKGROUND ART

Axial flow fans move air, or other fluids, using rotating impeller blades. As the impeller blades rotate, different pressures on opposing sides of the blades are developed. The discharge side of the impeller blades typically develops a high pressure while the intake side develops a low pressure. The pressure differential between these two sides can cause the fluid to flow from the high-pressure discharge side to the low-pressure intake side near the tips of the impeller blades. It is well known that this back flow can decrease the efficiency of the fan and may lead to undesirable noise generation.

One approach to reducing or preventing the back flow of air has been to minimize the gap between the blade tips and a surrounding shroud (commonly known as "tip gap"). This often involves tight tolerances in fan assembly manufacturing and design. Although backflow may indeed be reduced through minimization of the tip gap, the required tight tolerances can give rise to a host of complications. The tight tolerances commonly involve costly manufacturing and design to ensure that the impeller blades do not contact the surrounding shroud. Manufacturing, shipping, installation and operation all can be negatively impacted in attempts to minimize tip gap while still providing adequate clearance. Due to these complications, there are practical limitations which limit the minimization of tip gap, and therefore back flow often remains present.

Another approach to dealing with the back flow issue has been to form the shroud to provide a unique path for the back flow to recirculate through the impeller blades. These systems, instead of attempting to eliminate the back flow, reduce the impact of the back flow on the efficiency and noise characteristics of the fan. Although these configurations have been proven to reduce the impact of the back flow, effects can still be discernable. Methods and configurations attempting to minimize the impact of back flow, are often limited by the existence and quantity of back flow present. Therefore, reductions in quantity, or elimination of back flow, may prove to be more beneficial than attempts to minimize back flow impact.

It would therefore be highly desirable to have a fan and shroud assembly that was effective in reducing the quantity of back flow over the impeller blade tips. It would further be highly desirable to have such a fan shroud assembly that was not subject to the complications associated with designs attempting to minimize the clearance between the impeller blade tips and the shroud.

SUMMARY OF THE INVENTION

It is therefore an object of the present invention to provide a fan and shroud assembly with reduced back flow. It is a further object of the present invention to provide a fan and shroud assembly with an improved efficiency and reduced noise generation.

In accordance with the objects of the present invention, a fan assembly is provided. The fan assembly includes a plurality of impeller blades positioned within a rotating ring element. The rotating ring element includes a flared inner discharge surface. The fan assembly further includes a shroud element having an exit flange surface. The exit flange surface is substantially coincidental with the flared inner discharge surface.

Other features, benefits and advantages of the present invention will become apparent from the following description of the invention, when viewed in accordance with the attached drawings and appended claims.

DETAILED DESCRIPTION OF THE PREFERRED EMBODIMENT

Figure 1:
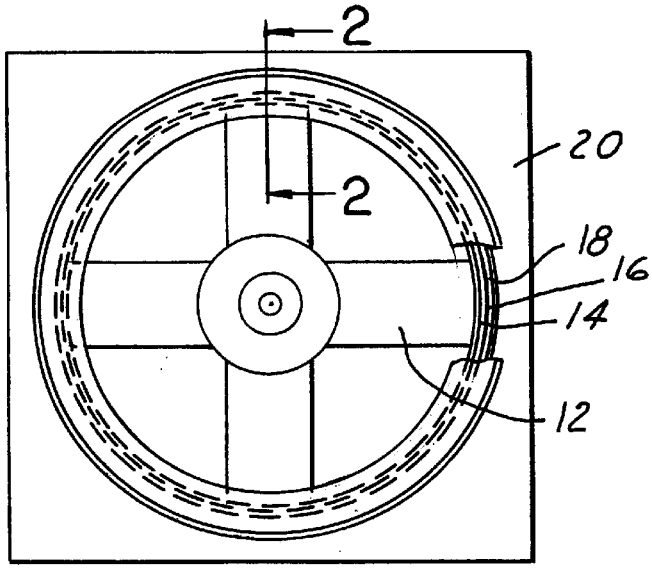
FIG. 1 is an illustration of an embodiment of a fan assembly in accordance with the present invention.

Referring now to FIG. 1 which is an illustration of a fan assembly 10 in accordance with the present invention. Although it is contemplated that the fan assembly 10 may be used in a variety of applications, in one embodiment, the fan assembly 10 is intended for use in an automotive cooling system. Specifically, the preferred embodiment of the present invention is intended for use in conjunction with a radiator cooling system in an automobile.

The fan assembly 10 includes at least one impeller blade 12 and a rotating ring element 14. The use of impeller blades 12 and a rotating ring element 14 to form fan assembly 10 is well know in the prior art and these fan assemblies 10 are commonly referred to as ring fans. In the past, pressure differentials between the intake and discharge sides of the fan assembly 10 have caused back flow to occur at the tips 16 of the impeller blades 12. Prior art approaches to dealing with this back flow have typically involved minimizing the tip gap 18 between the impeller tips 16 and the surrounding shroud 20 or have attempted to minimize the impact of such back flow by forming the shroud 20 with discrete recirculation paths (not shown). The present invention seeks to reduce the presence of such back flow without the difficulty and expense commonly associated with minimizing the tip gap 18.

Figure 2:
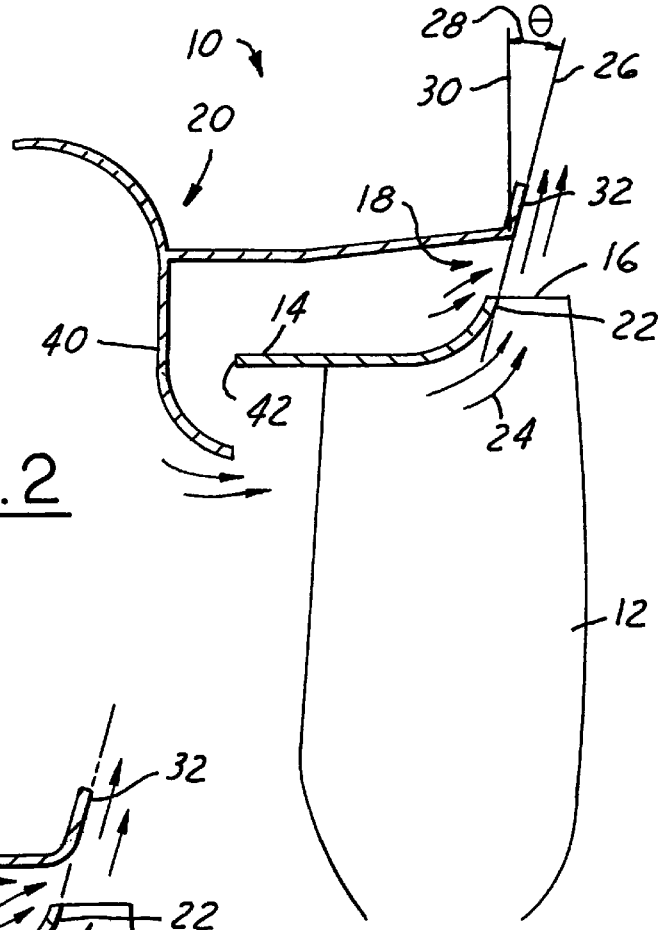
FIG. 2 is a cross-sectional illustration of a fan assembly in accordance with the present invention, the cross-section taken along the lines 2—2 in the directions of the arrows.

Referring now to FIG. 2 which is a cross-sectional illustration of a portion of an embodiment of a fan assembly 10 in accordance with the present invention. The rotating ring element 14 includes a flared inner discharge surface 22. The flared inner discharge surface 22 may be formed in a variety of fashions, although one embodiment, as illustrated in FIG. 2, envisions the flared inner discharge surface to be formed in a flared bell configuration. The significant feature of the flared inner discharge surface 22 is that the air 24, or other fluid, may be discharged at least partially in a radial direction 26 near the impeller tip 16. The discharge angle 28, measured from the purely radial plane 30 is anticipated to vary from 0° to 60°, although additional radial angles 28 may be possible.

Figure 3:
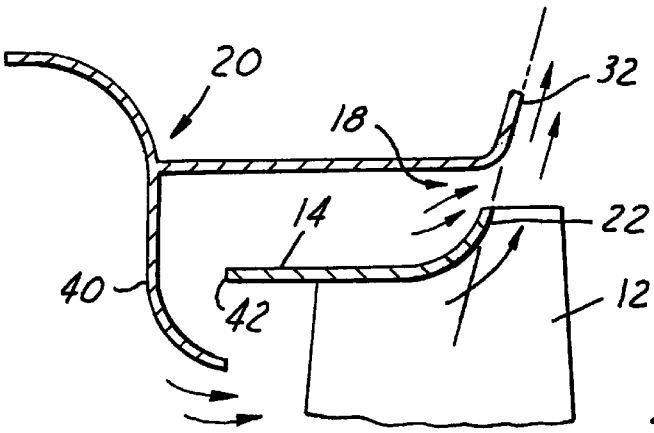
FIG. 3 is a cross-sectional illustration of an embodiment of a fan assembly in accordance with the present invention.

The fan assembly 10 further includes a shroud exit surface 32. The shroud exit surface 32 is substantially coincidental with the flared inner discharge surface 22. The term substantially coincidental is intended to include running tangent with the flared inner discharge surface 22 when the shroud exit surface 32 is rounded (see FIG. 3). The resultant novel feature of the present invention is that the fan assembly 10 utilizes the Coanda effect to seal off the tip gap 18 and thereby reduce or prevent back flow recirculation. The Coanda effect is a well-known aerodynamic effect discovered in 1930 by Henri-Marie Coanda. Coanda observed that a stream of air emerging from a nozzle tends to follow a nearby surface as long as the curvature or angle of the surface does not vary sharply from the flow direction. The present invention uses this effect such that the air 24 flows past the flared inner discharge surface 22 and along the shroud exit surface 32 without recirculating back through the tip gap 18. The present invention reduces or prevents such back flow even with relatively large tip gaps 18 and thereby reduces the cost and manufacturing difficulty previously associated with reductions in tip gap 18. Although one particular embodiment has described that effectuates the Coanda effect to prevent back flow, other methods of utilizing the Coanda effect to seal off tip gaps and recirculation may become obvious to those skilled in the art, and are contemplated by the present invention.

Although the Coanda effect is used by the present invention to prevent or reduce gap recirculation, the present invention adds further improvement to the efficiency of the fan assembly 10. As the air 24 passes over the flared inner discharge surface 22 and streams towards the substantially coincident shroud exit surface 32, an additional effect occurs and increases the efficiency of the fan assembly 10. An effect known in aerodynamic circles as entrainment takes place near the tip gap 18. Entrainment is a fundamental process in jet streams in which ambient fluid in proximity to a jet stream is incorporated into the stream. Thus, ambient air positioned between the rotating ring element 14 and the shroud 20 is pulled into the air stream 24 and discharged. In this fashion, the air flow and the efficiency of the fan assembly 10 is even further increased.

Figure 4:
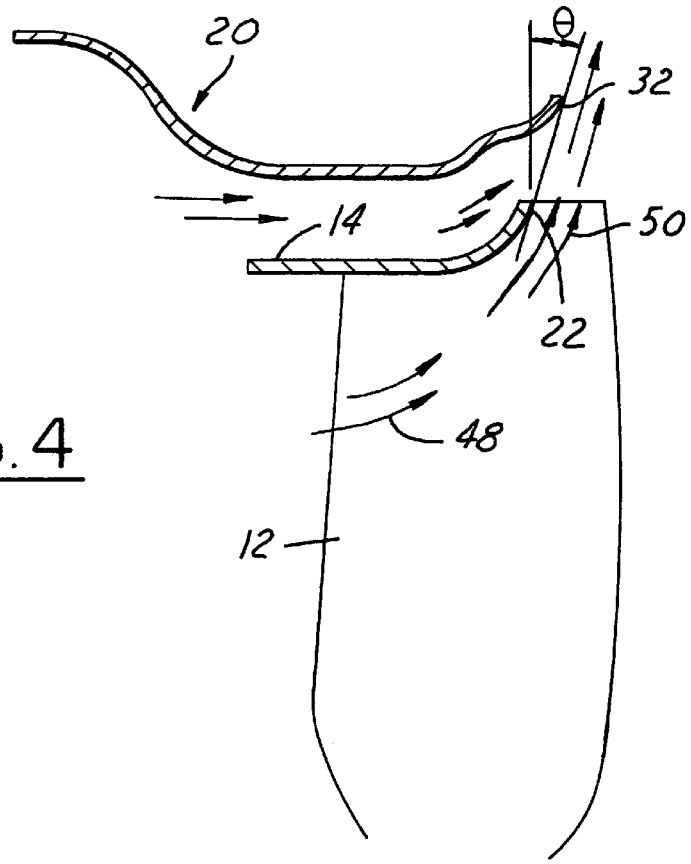
FIG. 4 is a cross-sectional illustration of an embodiment of a fan assembly in accordance with the present invention.
Figure 5:
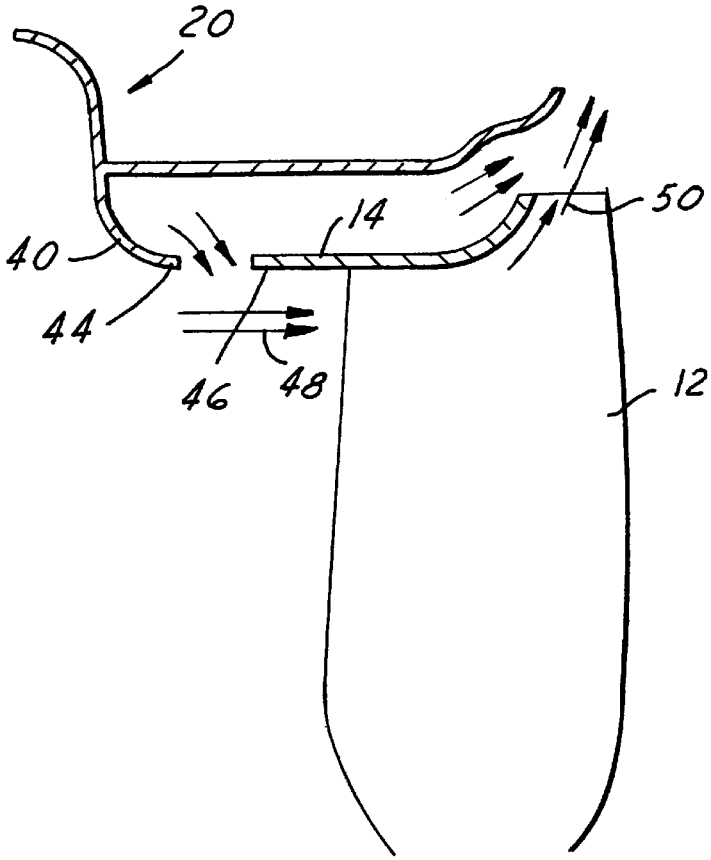
FIG. 5 is a cross-sectional illustration of an embodiment of a fan assembly in accordance with the present invention.

Although the most significant functional aspect of the present invention involves a relationship between the flared inner discharge surface 22 and the shroud exit surface 32, the shroud 20 may incorporate a variety of additional features. In one embodiment illustrated in FIG. 2, the shroud 20 may also include a front plate 40 shaped to provide a guide for air 24, or other fluid, flowing into the fan assembly 10. In one embodiment, the front plate 40 is intended to overlap the leading edge 42 of the rotating ring 14. In another embodiment, illustrated in FIG. 4, the front plate 40 may not be utilized or may be absent and air 24 within the tip gap 18 will still be discharged by way of entrainment. In still another embodiment, illustrated in FIG. 5, it is contemplated that the front plate 40 has a trailing edge 44 that is substantially coincident with the leading inner surface 46 of the rotating ring 14. Although several configurations for front plate 40 have been illustrated and described, it should be understood that a wide variety of shroud 20 configurations are contemplated which utilize the Coanda effect to prevent or reduce flow back.

While particular embodiments of the present invention have been shown and described numerous variations and alternative embodiments will occur to those skilled in the art. Accordingly, it is intended that the invention be limited to only terms of the appended claims.

What is claimed is:

1. A fan assembly comprising:

at least one impeller blade;

a rotating ring element having a flared inner discharge surface; and a shroud element including a shroud exit surface, said shroud exit surface being substantially coincident with said flared inner discharge surface such that a Coanda effect is generated in air flowing past said flared inner discharge surface and along said shroud exit surface.

2. A fan assembly as described in claim 1 wherein said shroud exit surface is curved, said shroud exit surface sharing a tangent with said flared inner discharge surface.

3. A fan assembly as described in claim 1 wherein said rotating ring produces a partial radial discharge flow.

4. A fan assembly as described in claim 1 further comprising:

a tip gap defined between said flared inner discharge surface and said shroud exit surface;

wherein ambient air positioned within said tip gap is drawn into a discharge flow produced by at least one impeller blade.

5. A fan assembly as described in claim 4 wherein back flow through said tip gap is prevented.

6. A fan assembly as described in claim 1 further comprising a front plate including a trailing edge.

7. A fan assembly as described in claim 6 wherein said trailing edge is positioned inboard of a leading edge of said rotating ring element.

8. A fan assembly as described in claim 6 wherein said trailing edge is substantially coincident with a leading surface of said rotating ring element.

9. A fan assembly comprising:

at least one impeller blade;

a rotating ring element having a flared inner discharge surface; and a shroud element including a shroud exit surface and defining a tip gap between said flared inner discharge surface and said shroud exit surface, said shroud exit surface being substantially coplanar with said flared inner discharge surface.

10. A fan assembly as described in claim 9 wherein said shroud exit surface is curved, said shroud exit surface sharing a tangent with said flared inner discharge surface.

11. A fan assembly as described in claim 9 wherein said rotating ring produces a partial radial discharge flow.

12. A fan assembly as described in claim 9 wherein ambient air positioned within said tip gap is drawn into a discharge flow produced by at least one impeller blade.

13. A fan assembly as described in claim 12 wherein back flow through said tip gap is prevented.

14. A fan assembly as described in claim 9 further comprising a front plate including a trailing edge.

15. A fan assembly comprising at least one impeller blade;

a rotating ring element having a flared inner discharge surface;

a shroud element including a shroud exit surface and defining a tip gap between said flared inner discharge surface and said shroud exit surface, said shroud exit surface being substantially coincident with said flared inner discharge surface; and a front plate including a trailing edge, said trailing edge is positioned inboard of a leading edge of said rotating ring element.

16. A fan assembly comprising at least one impeller blade;

a rotating ring element having a flared inner discharge surface;

a shroud element including a shroud exit surface and defining a tip gap between said flared inner discharge surface and said shroud exit surface, said shroud exit surface being substantially coincident with said flared inner discharge surface; and a front plate including a trailing edge, said trailing edge is substantially coincident with a leading surface of said rotating ring element.

* * * * *